United States Patent [19]

Castel et al.

[11] Patent Number: 4,501,056

[45] Date of Patent: Feb. 26, 1985

[54] TOOL FOR DISCONNECTING A GUIDELINE CONNECTOR AND A PROCESS FOR USING SAME

[75] Inventors: Yvon Castel; Michel Iato, both of Pau, France

[73] Assignee: Societe Nationale Elf Aquitaine (Production), France

[21] Appl. No.: 486,743

[22] Filed: Apr. 20, 1983

[30] Foreign Application Priority Data

Apr. 26, 1982 [FR] France ..... 82 07122

[51] Int. Cl.[3] ..... B23P 19/04

[52] U.S. Cl. ..... 29/252; 166/340; 405/224; 405/190

[58] Field of Search ..... 29/252; 166/338, 340, 166/341; 405/190, 191, 195, 224

[56] References Cited

U.S. PATENT DOCUMENTS

| | | | |
|---|---|---|---|
| 3,513,909 | 5/1970 | Peterman et al. | 166/340 X |
| 4,138,148 | 2/1979 | Zaremba | 166/340 X |
| 4,439,068 | 3/1984 | Pokladnik | 166/338 X |
| 4,443,130 | 4/1984 | Hall | 405/190 |

FOREIGN PATENT DOCUMENTS

| | | |
|---|---|---|
| 2282580 | 8/1974 | France . |
| 2389066 | 3/1978 | France . |

*Primary Examiner*—Frederick R. Schmidt
*Assistant Examiner*—Steven P. Schad
*Attorney, Agent, or Firm*—Poms, Smith, Lande & Rose

[57] ABSTRACT

The invention provides a tool for disconnecting a guideline connector hooked in a sleeve forming the extension of a guide column of an underwater station, by means of retractable locking heads housed in a bore in the body of the connector.

It comprises a re-entry cone, whose upper cylindrical part 1, adapted to cap the top of the connector having helical ramps, comprises swivel pins to cooperate with said ramps and is connected to a widened cylindrical part 4, ending in an upturned funnel 5, by a truncated cone-shaped part 3, with which are associated valve means 18 for controlling hydraulic cylinders 14 and 14*a* responsive to the pressure exerted by the body of the connector, when the re-entry cone rests on the connector, as well as two hydraulic cylinders 14 and 14*a* and hydro-pneumatic accumulator 12, mounted outside the cone.

7 Claims, 2 Drawing Figures

Figure 1:
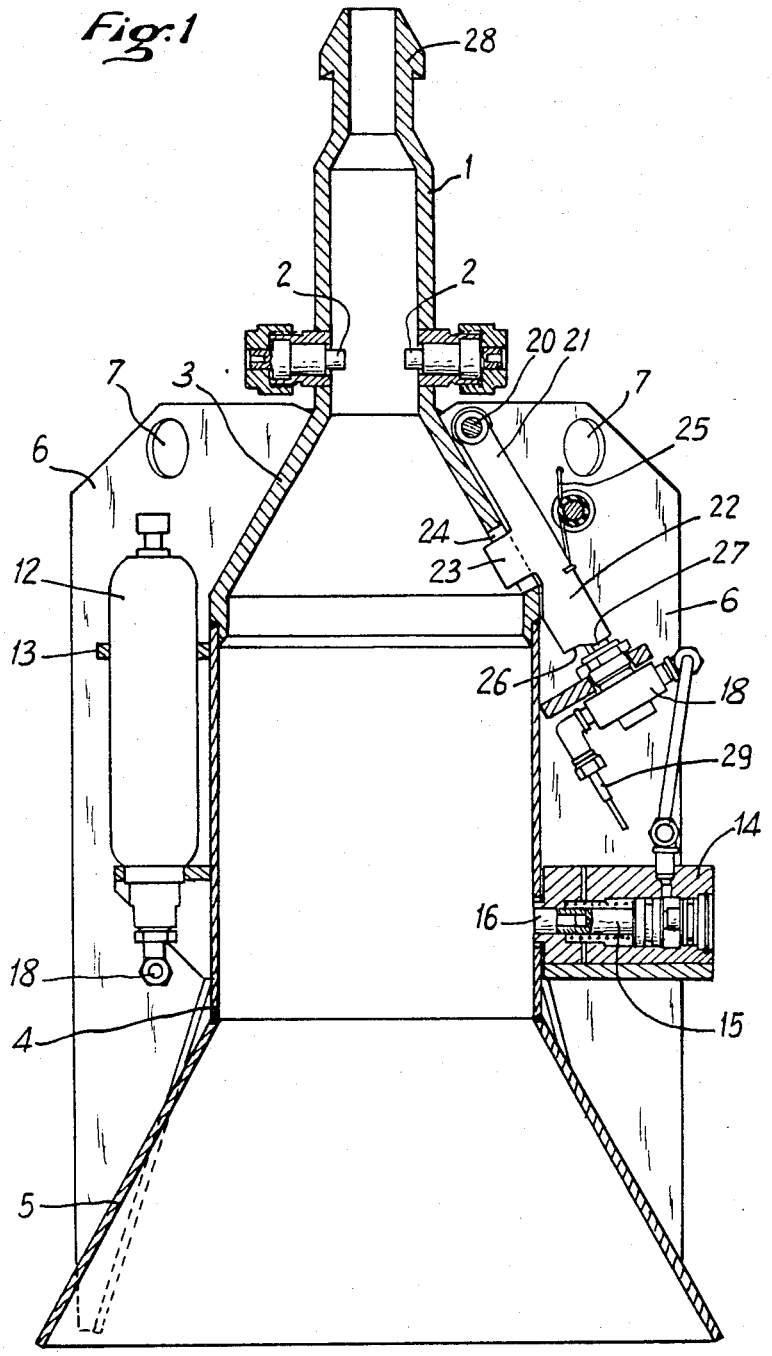

28
1
2
2
20 21
7
3
7
25
6
22
24
27
23
12
6
13
26
18
29
14
16
18
15
4
5

TOOL FOR DISCONNECTING A GUIDELINE CONNECTOR AND A PROCESS FOR USING SAME

The present invention relates to a tool for disconnecting a connector mounted on a guide column of an underwater station.

A U.S. Pat. No. 4,400,112 issued Aug. 23, 1983, in the name of the applicant divulged a guideline connector locked in a sleeve, forming the extension of the guide column, by means of retractable locking heads housed, in diametrically opposite positions, inside a bore of the connector body.

The present invention relates to a tool for disconnecting such a connector, whose upper part has been provided for this purpose with helical ramps, comprising two diametrically opposite disconnecting fingers, the ends of which exert a thrust on the retractable locking heads so as to cause them to retract inside the bore of the connector and which is characterized in that the tool comprises a re-entry cone, whose cylindrical upper part adapted to cap the top of the connector provided with helical ramps comprises swivel pins cooperating with said ramps to ensure the angular positioning of the re-entry cone, which cone is connected to a wider cylindrical part, serving for housing the body of the connector and ending in a part shaped as an upturned funnel, by a truncated cone-shaped part with which are associated means for controlling hydraulic cylinders sensitive to the pressure exerted by the body of the connector, when the re-entry cone rests with all its weight on the guideline connector, as well as two hydraulic cylinders mounted externally of the cone.

In a particularly advantageous embodiment, the hydraulic cylinder control means comprise a lever mounted resiliently on the outer wall of the truncated cone-shaped part of the re-entry cone, which lever pivotably mounted about a fixed point at one of its ends is provided at its opposite end with a cam surface cooperating with a hydraulic cylinder actuating means, said lever being provided with a knob penetrating through an aperture formed in the truncated cone-shaped casing and projecting there inside so that the pressure exerted on this knob from the inside of the casing causes the lever to be raised. The hydraulic cylinder actuating means may comprise a pin controlling the opening of a valve for supplying these cylinders with operating fluid. The invention also relates to a process for deconnecting the guideline connector by means of said tool and which is characterized in that the re-entry cone equipped with a hydro-pneumatic accumulator, two hydraulic cylinders and a cylinder control lever is lowered into the sea along the guideline, the lever being applied to the outer wall of the truncated cone-shaped casing of the tool by means of a spring, as soon as the top of the connector meets the upper cylindrical part of the re-entry cone, this latter is orientated angularly so that the two hydraulic cylinders are opposite the retractable locking heads of the connector, the levered knob, pushed back in contact with the body of the connector, actuates the supply for the hydraulic cylinders, whose fingers cause the locking heads to retract within the bore of the connector body, then a pull is exerted on the guideline and the connector is raised at the end of the guideline. Preferably, the piston of the hydraulic cylinder exerts the thrust on the retractable heads of the locking bolt by means of fingers made from resilient shearable material, such as polypropylene, the fingers severed during the manoeuver being able to rise freely to the surface because of their low density.

Figure 2:
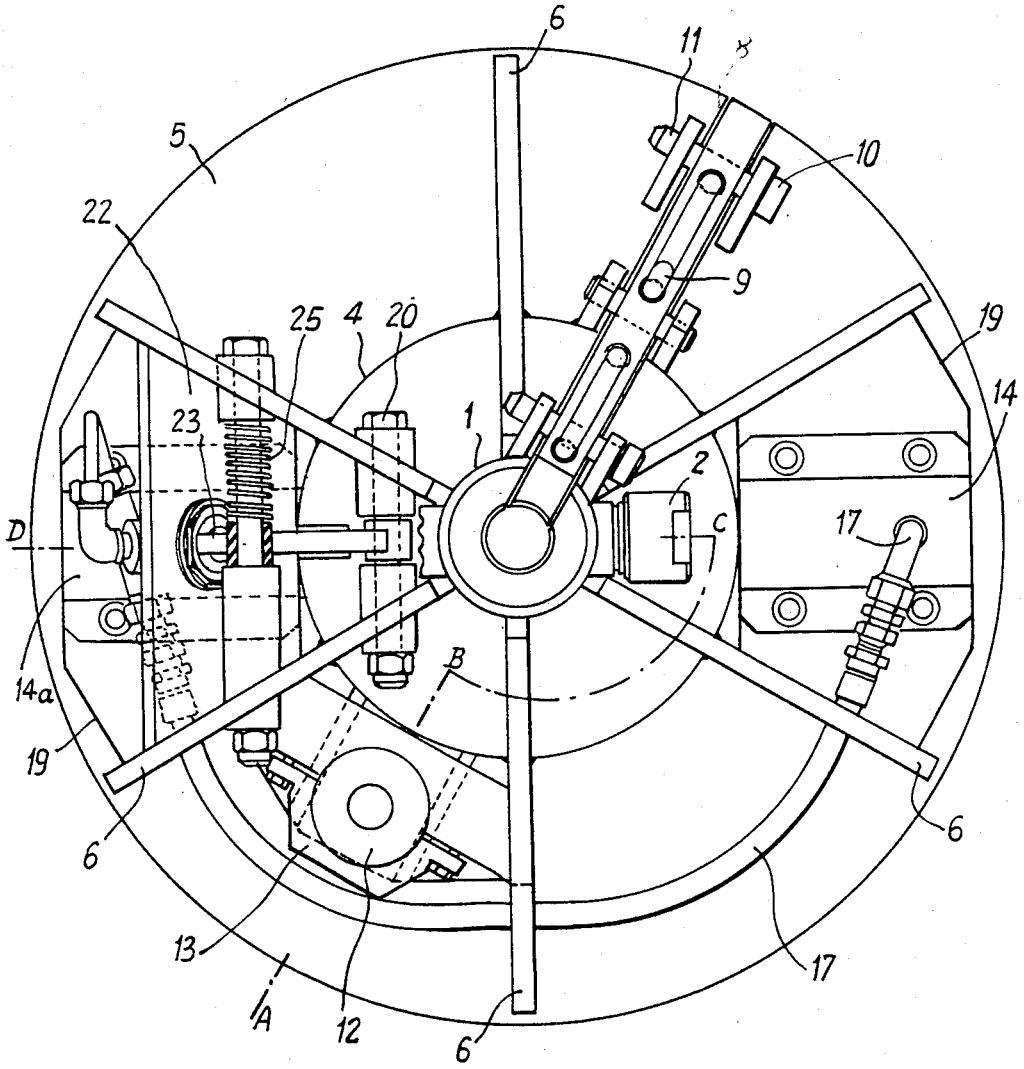

Other features of the invention will appear from the following description of one embodiment illustrated by the drawings, in which:

FIG. 1 shows an longitudinal section along the broken lines A-B-C-D shown in FIG. 2 of the tool, and FIG. 2 is a top view of the tool according to the invention.

The re-entry cone is formed by cylindrical upper part 1, topped by a pickup head 28 and having two swivel pins or rollers 2, situated diametrically opposite each other and projecting inside the cylindrical part 1, and a bell-mouthed truncated cone-shaped part 3 joined to a wider cylindrical part 4 which ends in an upturned funnel 5.

Over the whole height of the re-entry cone are welded six radial vertical plates 6 forming strengthening elements, said plates being provided at their upper parts with eyelets 7 for securing hooks for cables used for positioning the tool on the guideline before causing it to be sent in free fall along this guideline.

A longitudinal slot 8 passes laterally through the cone on the whole of its height for introducing the guideline inside the cone and placing same in the axis of the cone. This slot is fitted with a door 9 for closing the slot and locking it by means of a pin 10 and a split pin 11, after introducing the guideline therein.

To the cylindrical part 4 is fixed a cylinder 12 serving as hydro-pneumatic accumulator, by means of a clamping collar 13. Two hydraulic cylinders 14 and **14*a* are also mounted, by means of welded metal sheets 19, to the cylindrical part on each side of a plane offset with respect to the accumulator 12. They are provided with pistons 15 having at their ends polypropylene fingers 16**.

Each hydraulic cylinder 14 and **14*a* is connected by means of a hose 17 to a self-controlled valve 18, which is further connected to the accumulator 12 by a hose 29**.

To the side of the truncated cone-shaped part 3 is fixed, by means of a hinge pin 20, a control means including a lever 21 integral with a lever plate 22 having a knob 23 penetrating into an aperture 24 formed in part 3 and urged resiliently against the outer face of part 3 by means of a spring 25 bearing on a vertical stiffening plate 6.

The lower edge of the lever plate 22 is shaped as a cam surface 26 cooperating with a pin 27 forming part of the valve assembly 18. This valve is constructed so that raising of pin 27 causes opening thereof.

The process for using the tool is the following.

On a barge the tool is fitted onto a guideline connected to a guide column supported by an underwater station, by opening door 9 and closing it again by locking it, so as to pass the guideline along the longitudinal axis of the re-entry cone. The tool is lowered in free fall along the guideline, possibly using for greater safety a cable hooked into one of the eyelets 7.

Lever 21 and its plate 22 are applied by the force of spring 25 against the truncated cone-shaped casing 3, so that knob 23 projects inside the casing 3. With pin 27 in its low position, valve 18 remains closed.

When the re-entry cone comes into a position to cap the guideline connector, the top of the connector having helical ramps meets the swivel pins 2 placed on the upper cylindrical part 1 on the tool and the tool is orientated angularly to assume a position such, when the tool rests entirely on the connector, that the retractable heads of the connector are located opposite the two hydraulic cylinders 14 and 14*a* provided with fingers 16.

Under the weight of the tool, the connector exerts a pressure on knob 23, which, by retracting, causes lever 21 and its plate 22 to be raised against the resistance opposed by spring 25.

The cam surface edge 26, by moving, causes pin 27 to rise and valve 18 to open. The fluid coming from the accumulator 12 passes through valve 18 and is directed to one of the two hydraulic cylinders 14 and 14*a* by passing through the hose 17. Pistons 15 thus actuated exert a thrust through fingers 16, penetrating inside apertures in the sleeve housing the connector, on the retractable heads of said connector, which retract into the bore in the body of the connector.

When a pull is exerted on the guideline from the barge, the body of the connector, freed from the sleeve of the guide column rises at the end of the guideline, the polypropylene fingers 16 being severed by the action of the edges defining the apertures in the sleeve. The tool is raised accompanied by the connector. Raising of the tool may be further facilitated by pulling on the cable hook to one of the eyelets 7 of the re-entry cone.

The invention is not limited to the embodiment described and numerous variations may be made to this embodiment, particularly in the arrangement of the members responsive to the pressure exerted by the weight of the tool for controlling the automatic opening of the valve supplying the hydraulic cylinders with working fluid.

We claim:

1. A tool for disconnecting a guideline connector on a guide column of an underwater station, said connector being locked in a sleeve forming an extension of the guide column by retractable locking heads housed in diametrically opposite positions, inside a bore in the body of the connector and penetrating inside corresponding apertures formed in the body of the sleeve, said connector having helical ramps; said tool including two diametrically opposite disconnect fingers having inner ends to exert a thrust on the locking heads so as to cause said heads to retract inside the bore of the connector body characterized in that:

said tool comprises a re-entry cone having an upper cylindrical part (1) adapted to cap the top of the connector;

said tool including swivel pins (2) cooperating with said ramps to angularly position the re-entry cone with respect to said locking heads, said cone including a truncated cone-shaped part (3) below said upper cylindrical part (1), a wider cylindrical part (4) below said cone shaped part (3) for housing the connector body, and a lower upturned funnel portion (5);

oppositely disposed hydraulic cylinders (14 and 14*a*) mounted on said cylindrical part (4) exteriorly of said cone; and control means exteriorly of said cone including valve means (18) for actuating said hydraulic cylinders (14 and 14*a*);

said control means including an inwardly directed contact element (23) projecting through and inwardly of the inner surface of the truncated part (3) and responsive to the pressure exerted by the connector body to actuate valve means (18) when the re-entry cone rests with its weight on the guideline connector for activating said hydraulic cylinders (14 and 14*a*) to cause retraction of said locking heads.

2. A tool as claimed in claim 1, wherein said control means comprises:

a lever (21) resiliently bearing on the outer wall of the truncated cone-shaped part (3), said lever (21) being pivotally mounted at one end on said cone, the other end of said lever (21) having a cam surface (26), means (27) on said valve means (18) cooperable with said cam surface (26) for actuating said hydraulic cylinders (14, 14*a*), said lever (21) carrying said contact element (23), said truncated cone-shaped part (3) having an aperture through which said contact element (23) projects so that pressure of the connector on said contact element from the inside of the cone causes said lever (21) to be raised to activate said hydraulic cylinders (14 and 14*a*).

3. The tool as claimed in claim 2, wherein said means (27) for actuating said hydraulic cylinders includes a pin (27) controlling the opening of valve means (18) for supplying the hydraulic cylinders with working fluid.

4. The tool as claimed in claim 1 characterized in that hydraulic cylinders (14 and 14*a*) are mounted in diametrically opposite positions on cylindrical part (4) of the re-entry cone at locations corresponding to the retractable locking heads of the connector when said cone rests on said guideline connector, and aperture means provided in said cylindrical part (4) for passage therethrough of fingers (16) to cause retraction of said locking heads for disconnecting the tool.

5. The tool as claimed in claim 1 including:

a hydro-pneumatic accumulator (12) mounted on the re-entry cone, said accumulator being connected with said hydraulic cylinders (14 and 14*a*) through valve means 18 controlled by said lever (21).

6. The tool as claimed in claim 4 wherein:

said fingers (16) are made from a shearable resilient material.

7. In a process for disconnecting a guideline connector by a tool as claimed in claim 1 which includes said re-entry cone equipped with a hydro-pneumatic accumulator (12), said two hydraulic cylinders (14 and 14*a*) having fingers (16) for pressure engagement with locking heads on the connector, said tool including said contact element contacting said valve means (18) for controlling said hydraulic cylinders; characterized by the steps of:

lowering and angularly orienting the re-entry cone to position the two hydraulic cylinders in juxtaposed relation to the retractable locking heads of the connector;

causing said contact element to move as the re-entry cone comes to rest on the connector to actuate valve means (18) for supplying pressure fluid to the hydraulic cylinders to cause said fingers (16) to retract the locking heads within the body of the connector;

and exerting a pull on the guideline to shear said fingers (16) and to raise the connector at the end of the guideline.

* * * * *